US006227904B1

(12) United States Patent
Wang et al.

(10) Patent No.: US 6,227,904 B1
(45) Date of Patent: May 8, 2001

(54) COMPOUND TYPE CONNECTOR

(75) Inventors: Yao Do Wang; Gin Ei Lee, both of Taipei Hsien (TW)

(73) Assignee: Ya Do Wang, Taipei Hsien (TW)

( * ) Notice: Subject to any disclaimer, the term of this patent is extended or adjusted under 35 U.S.C. 154(b) by 0 days.

(21) Appl. No.: 09/390,374

(22) Filed: Sep. 7, 1999

(51) Int. Cl.[7] ..... H01R 13/66

(52) U.S. Cl. ..... 439/541.5; 439/607; 439/63; 439/540.1

(58) Field of Search ..... 439/63, 541.5, 439/607, 609, 939, 541, 80, 79, 540.1, 92, 108

(56) References Cited

U.S. PATENT DOCUMENTS 4,878,856 * 11/1989 Maxwell ..... 439/540
4,908,335 * 3/1990 Cosmos et al. ..... 439/79
4,913,664 * 4/1990 Dixon et al. ..... 439/607
5,037,330 * 8/1991 Fulponi et al. ..... 439/607
5,842,872 * 12/1998 Hosler, Sr. et al. ..... 439/63
6,074,218 * 6/2000 Wu ..... 439/63

* cited by examiner

*Primary Examiner*—Paula Bradley
*Assistant Examiner*—James R. Harvey
(74) *Attorney, Agent, or Firm*—Rosenberg, Klein & Lee

(57) ABSTRACT

A compound type connector comprises an insulating seat, an AV terminal connector, an S terminal connector and a housing. The insulating seat has a first receiving space and a second receiving space at the upper and lower spaces thereof. The AV terminal connector is installed within the first receiving space of the insulating seat. The AV terminal connector has a body. A plurality of terminals are installed within the body, and one end of each terminal protrudes out of the insulating seat. The S terminal connector is installed within the second receiving space. The S terminal connector has a body. The plurality of terminals are installed in the body, while one end of the terminals protrudes out of the insulating seat; and a housing encloses the insulating seat. The housing has at least one shielding surface, the shielding surface having an upper and a lower openings with respect to the AV terminal connector and the S terminal connector. By the aforesaid structure, a compound type connector integrating an AV terminal connector and an S terminal connector is formed.

3 Claims, 4 Drawing Sheets

COMPOUND TYPE CONNECTOR

FIELD OF THE INVENTION

The present invention relates to a compound type connector integrating an AV terminal connector and an S terminal connector.

BACKGROUND OF THE INVENTION

In the prior art connector, two AV terminal connectors are stacked to form as an integrated connector, or two S terminal connector are stacked to form as an integrated connector. However, no connector is formed by integrating an AV terminal connector and an S terminal connector.

SUMMARY OF THE INVENTION

Accordingly, the primary object of the present invention is to provide a compound type connector comprises an insulating seat, an AV terminal connector, an S terminal connector and a housing. The insulating seat has a first receiving space and a second receiving space at the upper and lower spaces thereof. The AV terminal connector is installed within the first receiving space of the insulating seat. The compound type connector integrating an AV terminal connector and an S terminal connector are formed.

Another object of the present invention is to provide a compound type connector, wherein the positions of the AV terminal connector and the S terminal connector can be exchanged.

The various objects and advantages of the present invention will be more readily understood from the following detailed description when read in conjunction with the appended drawing.

DETAILED DESCRIPTION OF THE PREFERRED EMBODIMENTS

Figure 1:
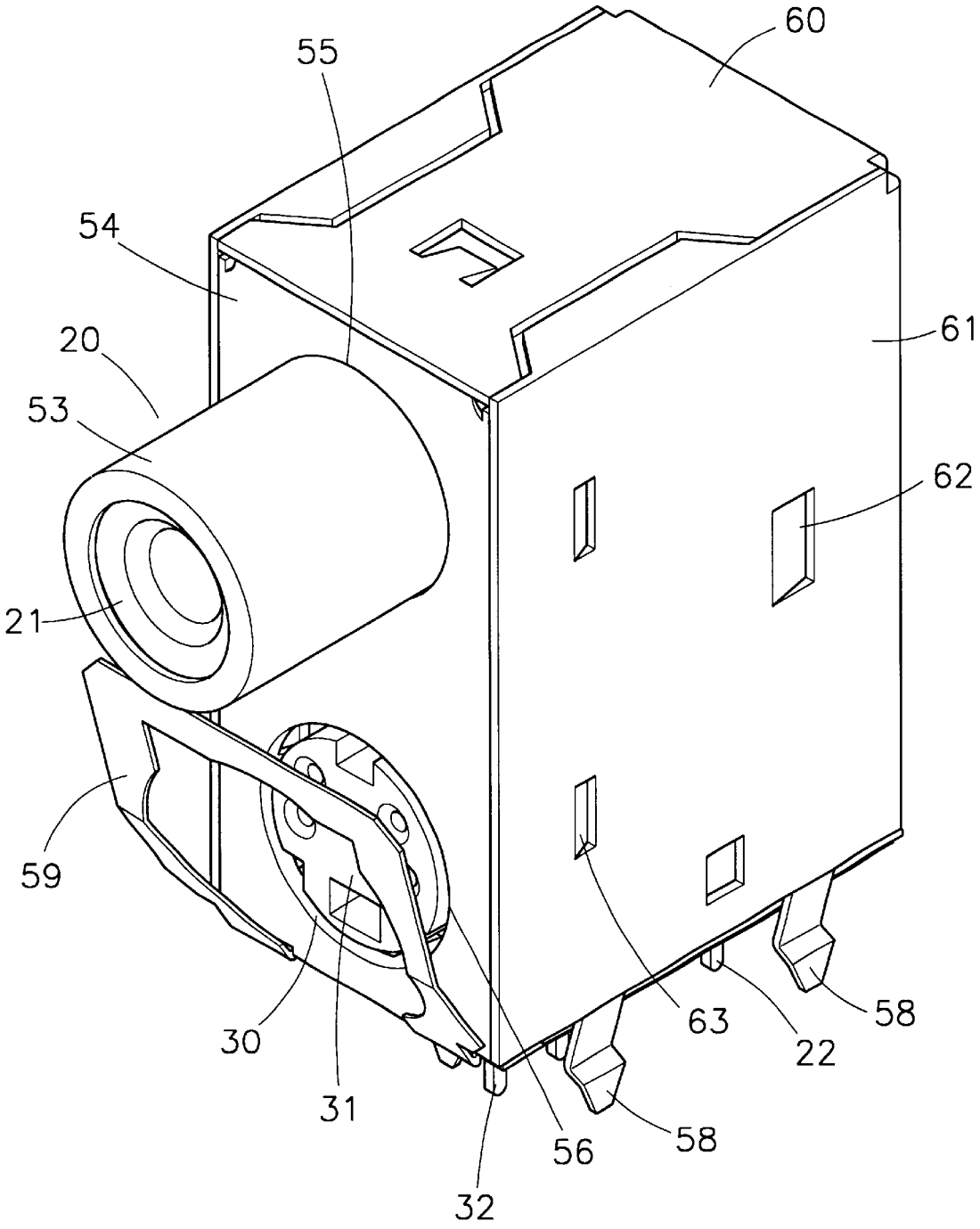
FIG. 1 is an assembled perspective view of the first embodiment in the present invention.
Figure 2:
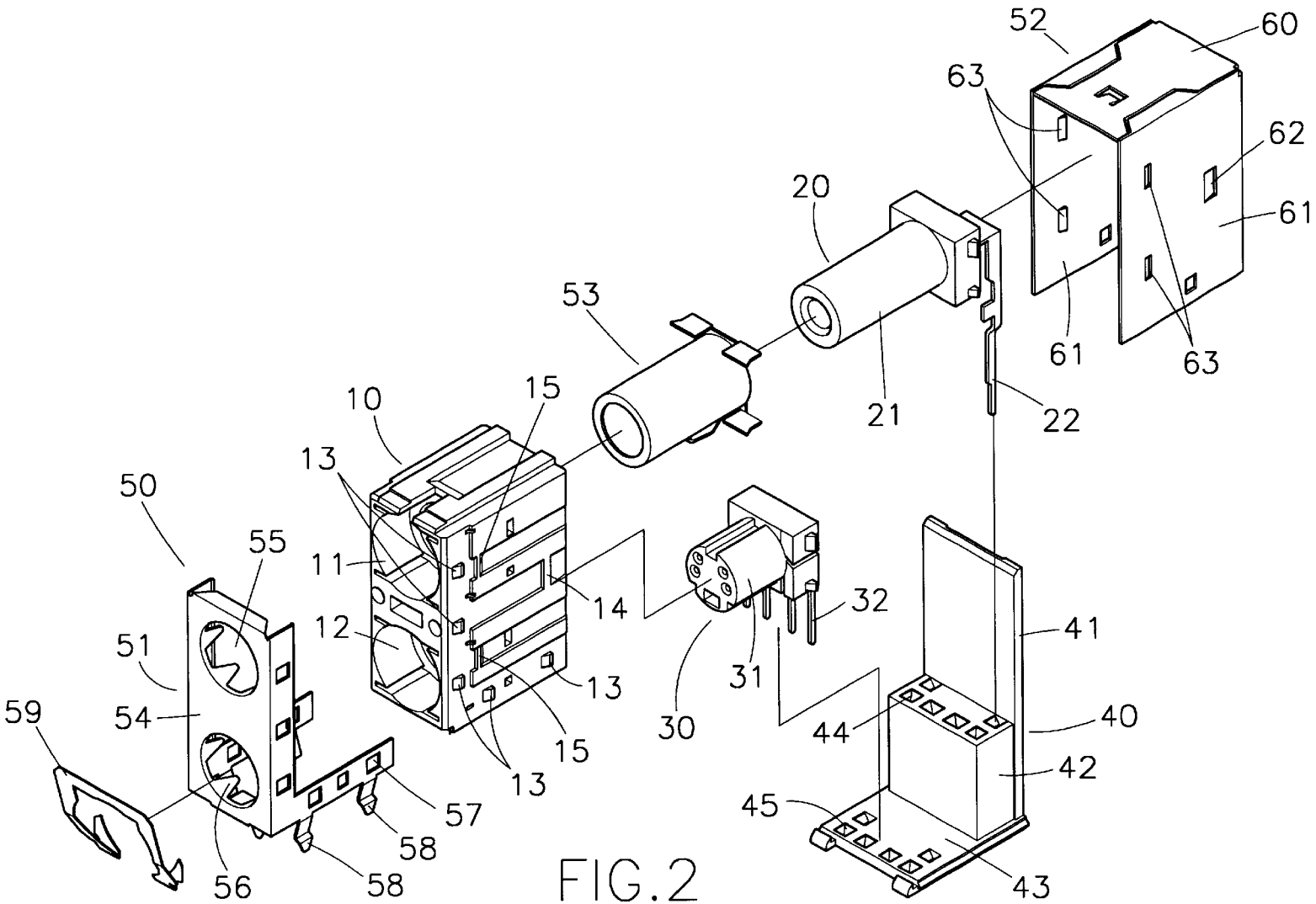
FIG. 2 is an exploded perspective view of the first embodiment in the present invention.
Figure 3:
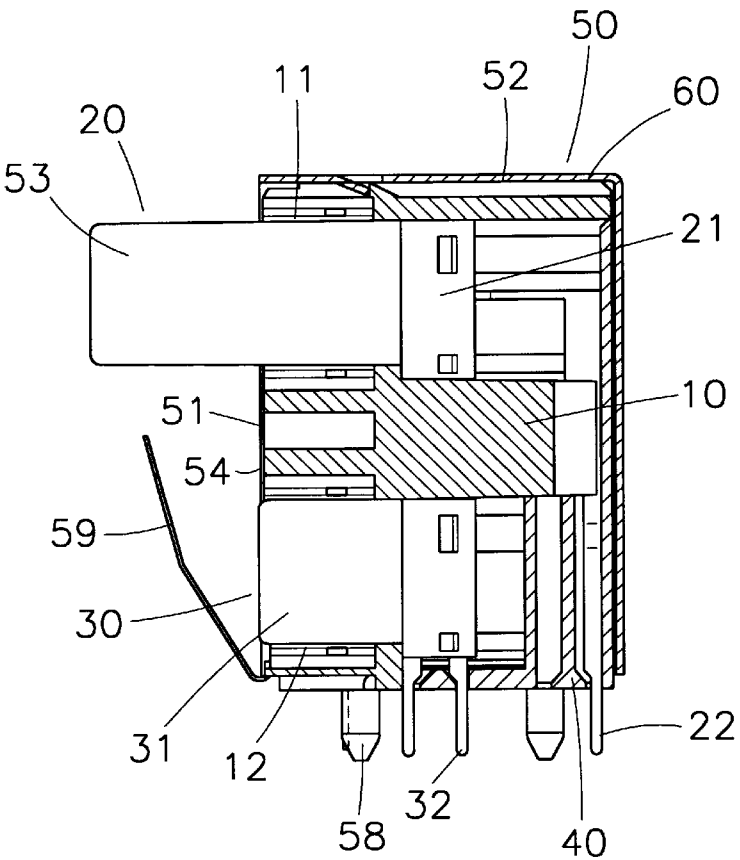
FIG. 3 is a cross sectional view of the embodiment in the present invention.

With reference to FIGS. 1, 2, and 3, the compound type connector of the present invention is illustrated. The compound type connector of the present invention includes an insulating seat 10, an AV terminal connector 20, an S terminal connector 30, a terminal seat 40 and a housing 50. The insulating seat 10 is made of plastic material or other insulating materials and is substantially divided as a first receiving space and 11 and a second receiving space 12 which both have approximately identical round spaces. Furthermore, a plurality of latching bodies 13, 14 and 15 protrudes from the two outer walls at two sides of the insulating seat 10.

The AV terminal connector 20 is installed within the first receiving space 11 of the insulating seat 10. The AV terminal connector 20 has a body 21 made of plastics or other insulating materials. A plurality of terminals capable of being electrically connected to an opposite connectors is installed within the body 21. The lower end of each terminal 22 of the AV terminal connector 20 protrudes to the bottom of the insulating seat 10.

An S terminal connector 30 is installed within the second receiving space 12 of the insulating seat 10. The S terminal connector has a body 31 made of plastics or other insulating materials. The body 31 is installed with a plurality of S terminals for being electrically connected to the terminal 32. The terminals 32 of S terminal connector 30 has a lower end protruding to the bottom of the insulating seat 10.

The terminal seat 40 is made of plastics or other insulating materials and has a stand plate 41 the front side of which is connected to a first base 42 and a second base 43. The first base 42 is higher than the second base 43. The first base 42 and second base 43 are installed with a plurality of penetrating first positioning holes 44, and second positioning holes 45, respectively. The insulating seat 10 is installed on the terminal seat 40, and the terminals 22 of the AV terminal connector 20 are inserted into the first positioning holes 44 so that the terminals can be steadily positioned. The terminals 32 of the S terminal connector are inserted into the second positioning holes 45 so that the terminals 32 are positioned steadily. The lower ends of the terminals 22 of the AV terminal connector 20 and the terminals 32 of the S terminal connector 30 protrudes out of terminal seat 40. The positioning holes 44, 45 are arranged to accommodate either of terminals 22 or 32.

The housing assembly 50 is made of materials capable of preventing electromagnetic interference (EMI). The housing assembly 50 includes a first housing 51, a second housing 52, and a third housing 53. The front side of the first housing 51 has a front shielding surface 54. The first housing 51 encloses the front side of the insulating seat 10. The shielding surface 54 is installed with two openings 55 and 56 with respect to the AV terminal connector 20 and S terminal connector 30 for being connected by an AV terminal connector 20 and an S terminal connector 30. Two sides of the first housing 51 are installed with a plurality of latching holes 57 for being engaged by the latching bodies 13 at outer walls of two sides of the insulating seat 10. A plurality of positioning legs 58 are installed at the bottom of the first housing 51 for being inserted into and fixed to a circuit board. The first housing 51 is plated with tin, this being beneficial to prevent corrosion of a circuit board. Moreover, a grounding elastic piece 59 can be further latched at the front side of the first housing 51 of the housing 50. The second housing 52 is formed by a top shielding surface 60 and two lateral shielding surfaces 61. The plurality of latching pieces 62, 63 are installed on the two lateral shielding surfaces 61 for being latched to the latching bodies 14, 15 at outer walls of two sides of the insulating seat 10. The third housing 53 has a cylindrical shape and encloses the body 21 of the AV terminal connector 21. The second housing 52 and the third housing 53 are plated with tin which is beneficial in production. By the aforesaid structure, a compound type connector integrating an AV terminal connector and an S terminal connector is formed.

Figure 4:
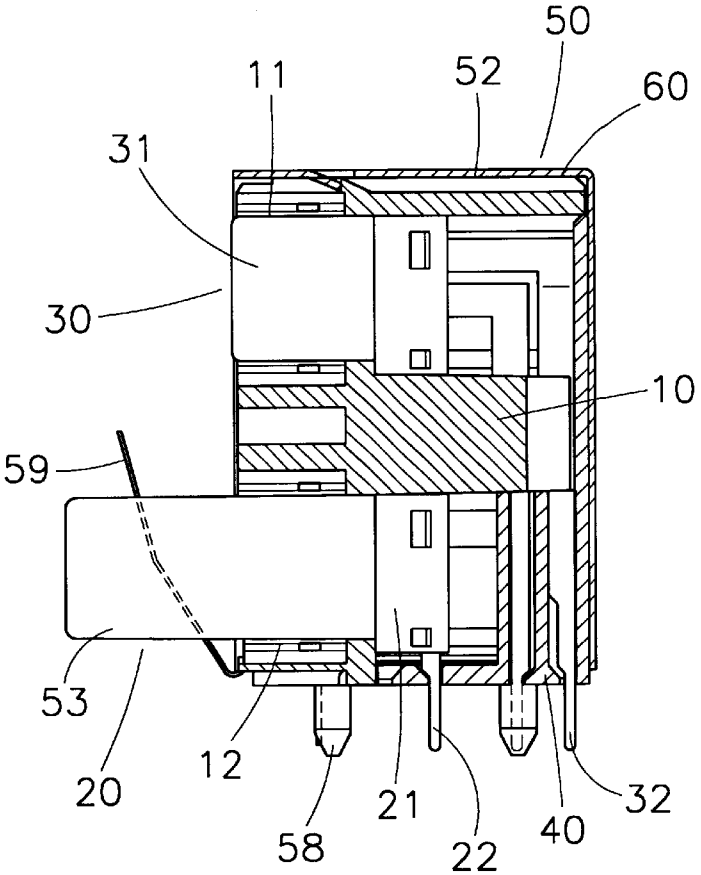
FIG. 4 is a cross sectional view of the second embodiment in the present invention.
Figure 6:
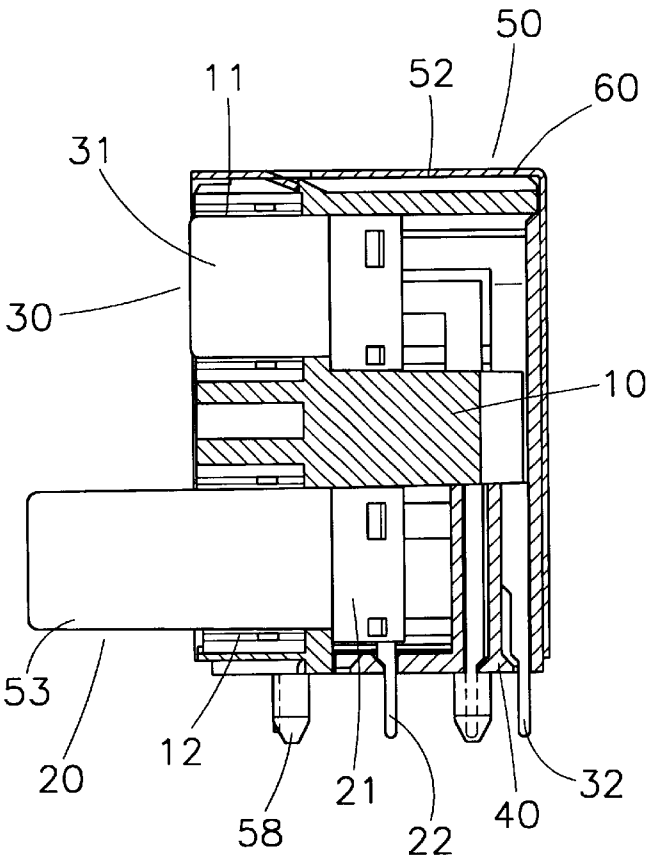
FIG. 6 is a cross sectional view of the fourth embodiment in the present invention.
Figure 5:
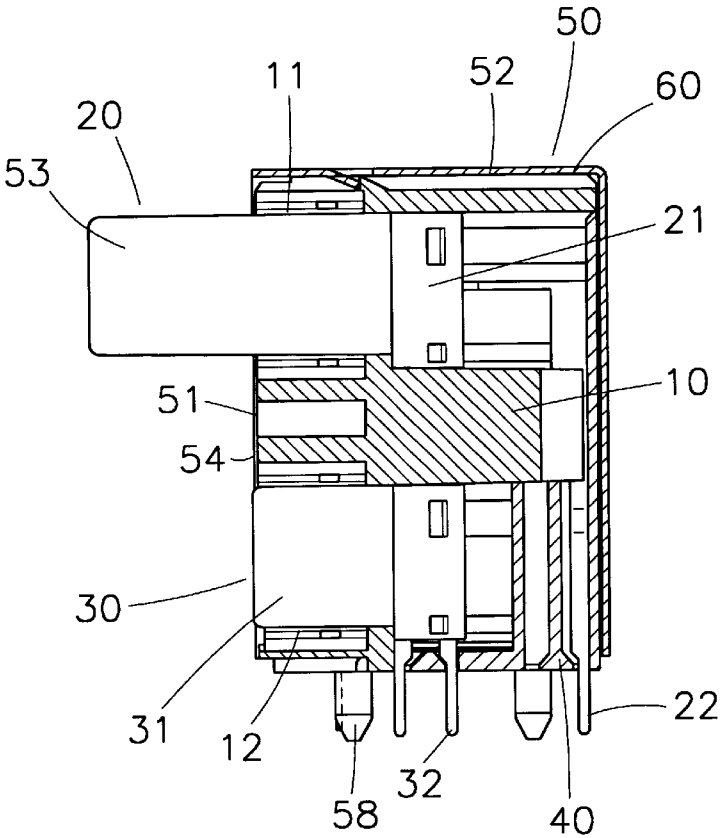
FIG. 5 is a cross sectional view of the third embodiment in the present invention.

In the present invention, the insulating seat 10 is installed with receiving spaces 11 and 12 at the upper and lower space thereof. The AV terminal connector 20 and S terminal connector 30 are independent. The two connectors can be installed at the receiving spaces 11 and 12 of the insulating seat 10. The AV terminal connector 20 and the S terminal connector 30 are integrated. Moreover, the positions of the AV terminal connector and the S terminal connector can be exchanged (as shown in FIGS. 4, 5, and 6). Thus, the cost can be reduced greatly.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A compound connector comprising:

an insulating seat having a first receiving space and a second receiving space respectively disposed at an upper space and a lower space thereof;

an AV terminal connector installed within one of the first and second receiving spaces of the insulating seat, the AV terminal connector having a body, a plurality of terminals being installed within the body and arranged in a first configuration, one end of each terminal protruding out of the insulating seat;

an S terminal connector installed within the other of the first and second receiving spaces, the S terminal connector having a body, a plurality of terminals being installed in the body and arranged in a second configuration, said second configuration being different than said first configuration, one end of the terminals protrudes out of the insulating seat;

a terminal seat coupled to said insulating seat, the terminal seat having a pair of bases each with a plurality of positioning holes formed therethrough for respective passage of the ends of the terminals of the AV terminal connector and the S terminal connector therethrough, the plurality of positioning holes of each of the pair of bases being arranged in a third configuration, the third configuration having a first portion of the plurality of positioning holes aligned with the first configuration of terminals and a second portion of the plurality of positioning holes aligned with the second configuration of terminals;

a housing enclosing the insulating seat and the terminal seat, the housing having at least one shielding surface, the shielding surface having an upper opening and a lower opening disposed in respective alignment with a corresponding one of the AV terminal connector and the S terminal connector; and, an elastic grounding member coupled to a lower end of the shielding surface and extending forwardly therefrom, the elastic grounding member having an opening disposed in aligned relationship with the lower opening of the shielding surface.

2. The compound connector as claimed in claim 1, wherein the AV terminal connector is installed in the first receiving space and the S terminal connector is installed in the second receiving space.

3. The compound type connector as claimed in claim 1, wherein the AV terminal connector is installed in the second receiving space and the S terminal connector is installed in the first receiving space.

* * * * *

UNITED STATES PATENT AND TRADEMARK OFFICE

CERTIFICATE OF CORRECTION

PATENT NO. : 6,227,904 B1
DATED : May 8, 2001
INVENTOR(S) : Yao Do Wang and Gin Ei Lee It is certified that error appears in the above-identified patent and that said Letters Patent is hereby corrected as shown below:

Title page,
Item [73], delete the assignee name "Ya Do Wang" and insert therefore -- Yao Do Wang --

Signed and Sealed this

Second Day of April, 2002

*Attest:*

*Attesting Officer*

JAMES E. ROGAN
*Director of the United States Patent and Trademark Office*